US008322490B1

(12) United States Patent
Loemker

(10) Patent No.: US 8,322,490 B1
(45) Date of Patent: Dec. 4, 2012

(54) TRAILER AND FLATBED LADDER APPARATUS

(76) Inventor: Neil Loemker, Swanton, OH (US)

( * ) Notice: Subject to any disclaimer, the term of this patent is extended or adjusted under 35 U.S.C. 154(b) by 420 days.

(21) Appl. No.: 12/579,535

(22) Filed: Oct. 15, 2009

(51) Int. Cl.
*E06B 9/00* (2006.01)

(52) U.S. Cl. ..... 182/127; 182/93; 182/95; 182/97; 114/362; 280/166

(58) Field of Classification Search ..... 182/93, 182/95, 97, 127, 163; 114/362; 280/166
See application file for complete search history.

(56) References Cited

U.S. PATENT DOCUMENTS

| | | | | | |
|---|---|---|---|---|---|
| 290,348 | A | * | 12/1883 | Olson | 182/83 |
| 2,896,831 | A | * | 7/1959 | Ellingson | 182/97 |
| 2,971,601 | A | * | 2/1961 | Fortune | 182/97 |
| 3,563,342 | A | | 2/1971 | Lasiter | |
| 3,861,499 | A | * | 1/1975 | Follett, Jr. | 182/163 |
| 3,892,290 | A | * | 7/1975 | Lang | 182/22 |
| 3,980,157 | A | * | 9/1976 | Wrigley | 182/163 |
| 4,021,071 | A | * | 5/1977 | Norman | 296/62 |
| 4,186,820 | A | * | 2/1980 | Cosman | 182/93 |
| 4,333,547 | A | | 6/1982 | Johansson | |
| 4,482,029 | A | * | 11/1984 | Prochaska | 182/96 |
| 4,492,286 | A | | 1/1985 | Lemire | |
| 4,541,507 | A | * | 9/1985 | Gibellato | 182/86 |
| 4,757,876 | A | | 7/1988 | Peacock | |
| 5,024,292 | A | | 6/1991 | Gilbreath et al. | |
| 5,113,782 | A | * | 5/1992 | McCarty | 114/362 |
| 5,123,372 | A | * | 6/1992 | Kobayashi et al. | 114/362 |
| 5,163,531 | A | * | 11/1992 | Whiting | 182/89 |
| 5,224,437 | A | * | 7/1993 | Stanescu | 114/362 |
| 5,287,945 | A | * | 2/1994 | Thurlow | 182/97 |
| D359,134 | S | | 6/1995 | Toews | |
| 5,732,996 | A | * | 3/1998 | Graffy et al. | 296/62 |
| 6,003,633 | A | | 12/1999 | Rolson | |
| 6,578,666 | B1 | | 6/2003 | Miller | |
| 6,942,271 | B1 | * | 9/2005 | Jamison et al. | 296/61 |
| 6,948,588 | B1 | * | 9/2005 | Chustak | 182/97 |
| 6,971,478 | B2 | * | 12/2005 | Bareket | 182/127 |
| 7,080,713 | B1 | * | 7/2006 | Riggs | 182/127 |
| 7,240,947 | B2 | * | 7/2007 | Kuznarik et al. | 296/62 |
| 7,401,798 | B2 | * | 7/2008 | Dolan | 280/163 |
| 7,503,276 | B1 | * | 3/2009 | Curi et al. | 114/362 |

* cited by examiner

*Primary Examiner* — Alvin Chin Shue
*Assistant Examiner* — Colleen M Chavchavadze

(57) ABSTRACT

The trailer and flatbed ladder apparatus provides ladder access to a trailer and to a flatbed. The apparatus is highly portable by way of being hinged between the upper and lower sections and due to the tubular construction. The apparatus may therefore be easily and space efficiently stored on and within a truck, bed, or trailer. The apparatus is removably positionable in a plurality of locations around a flatbed and trailer, wherever a stake pocket exists. The stake provides positive non-slip fit to a trailer and flatbed that negates unintentional movement and removal, thereby ensuring safety. Full pivot is provided between the stake and sleeve and the upper section. The apparatus removably fits snugly within the existing stake pockets of a flatbed and trailer due to the stake square outer corners and rounded inner corners that match existing stake pockets.

14 Claims, 5 Drawing Sheets

TRAILER AND FLATBED LADDER APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Anyone who must climb on to a trailer or flatbed understands the difficulty therein. While various types of ladders have been proposed for the task, none have provided all that is needed. A trailer and flatbed ladder device should first be fully removable so that trailers and flatbeds meet width regulations. Such a device should be lightweight. A ladder device for a truck or flatbed should also positively engage the flatbed or trailer so that there is no danger of the device becoming unintentionally disengaged. At the same time, a trailer and flatbed ladder apparatus should be easily removed and locatable in a variety of positions around a flatbed or trailer. A properly designed device should fully pivot proximal to its trailer and flatbed mounting point so that various heights of trailers and flatbeds can be accommodated and so that the device may be pivoted up onto the trailer or bed if desired. Basic design is also a beneficial quality, as production costs and light weight are a typical result of such designs. The present apparatus fulfills the needs of a trailer and flatbed ladder.

FIELD OF THE INVENTION

The trailer and flatbed ladder apparatus relates to ladder devices for accessing trailer beds and flatbeds.

SUMMARY OF THE INVENTION

The general purpose of the trailer and flatbed ladder apparatus, described subsequently in greater detail, is to provide a trailer and flatbed ladder apparatus which has many novel features that result in an improved trailer and flatbed ladder apparatus which is not anticipated, rendered obvious, suggested, or even implied by prior art, either alone or in combination thereof.

To attain this, the apparatus provides ladder access to a trailer and to a flatbed. The trailer and flatbed ladder apparatus is highly portable by way of being hinged and also due to the tubular construction, ideally of aluminum, factors that contribute to light weight. The apparatus may therefore be easily and space efficiently stored on and within a truck, bed, or trailer. Portability and storage are further enhanced by the 18 inch width of the apparatus.

The apparatus is removably positionable in a plurality of locations around a flatbed and trailer, wherever a stake pocket exists. The stake provides positive non-slip fit to a trailer and flatbed that negates unintentional movement and removal and thereby ensures safety. The most complete embodiment provides full pivot between the stake and sleeve and the upper section. The apparatus removably fits snugly within the existing stake pockets of a flatbed and trailer due to the stake square outer corners and rounded inner corners that match existing stake pockets.

Thus has been broadly outlined the more important features of the improved trailer and flatbed ladder apparatus so that the detailed description thereof that follows may be better understood and in order that the present contribution to the art may be better appreciated.

An object of the trailer and flatbed ladder apparatus is to be highly portable.

Another object of the trailer and flatbed ladder apparatus is to be lightweight.

A further object of the trailer and flatbed ladder apparatus is to be removably positionable in a plurality of locations around a flatbed and trailer.

An added object of the trailer and flatbed ladder apparatus is to provide positive non-slip fit to a trailer and flatbed, fit that negates unintentional movement and removal.

And, an object of the trailer and flatbed ladder apparatus is to pivotally and removably mount to a flatbed and to a trailer.

A further object of the trailer and flatbed ladder apparatus is to collapse into a relatively small size and shape.

And, an object of the trailer and flatbed ladder apparatus is to removably fit within the existing stake pockets of a flatbed and trailer.

These together with additional objects, features and advantages of the improved trailer and flatbed ladder apparatus will be readily apparent to those of ordinary skill in the art upon reading the following detailed description of presently preferred, but nonetheless illustrative, embodiments of the improved trailer and flatbed ladder apparatus when taken in conjunction with the accompanying drawings.

In this respect, before explaining the current embodiments of the improved trailer and flatbed ladder apparatus in detail, it is to be understood that the trailer and flatbed ladder apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved trailer and flatbed ladder apparatus. It is therefore important that the claims be regarded as including such equivalent constructions insofar as they do not depart from the spirit and scope of the trailer and flatbed ladder apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the trailer and flatbed ladder apparatus generally designated by the reference number 10 will be described.

Figure 1:
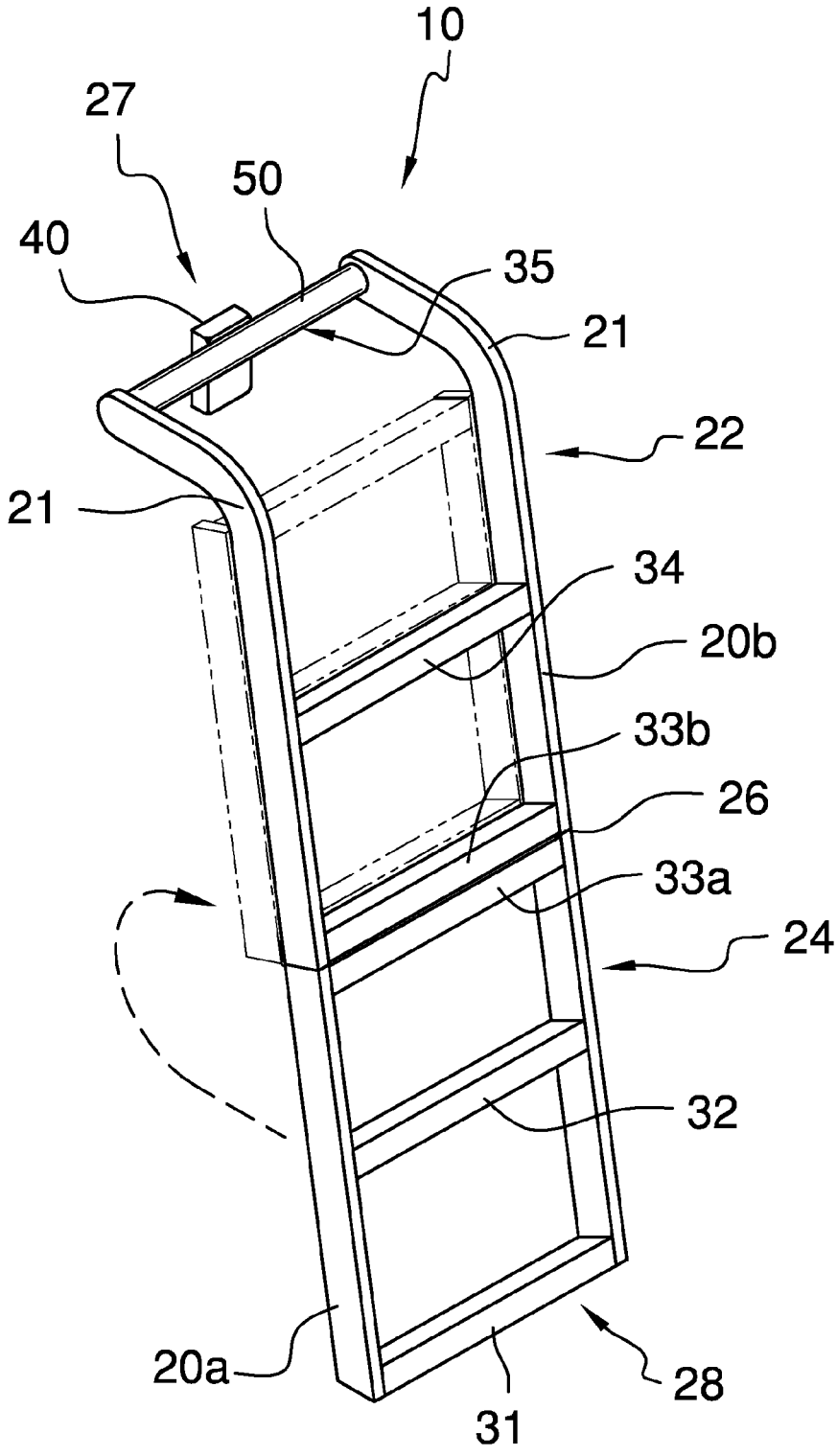
FIG. 1 is a perspective view.

Referring to FIG. 1, the apparatus 10 partially comprises the pair of identical spaced apart rails comprising the first rail 20*a* and the second rail 20*b*. The rails have a top 27 spaced apart from the bottom 28. The upper section 22 is hingedly attached to the lower section 24 at the division 26. The plurality of spaced apart rungs is disposed on the lower section 24 between the rails. The lower section rungs comprise the first rung 31 disposed on the lower section 24 bottom and the second rung 32 disposed above the first rung 31.

The lower third rung 33*a* is disposed above the second rung 32. The lower third rung 33*a* is disposed at the division 26. The plurality of spaced apart rungs is disposed between the rails of the upper section 22. The upper section 22 rungs partially comprise the upper third rung 33*b* disposed at the division 26. The upper third rung 33*b* is disposed adjacent to the lower third rung 33*a*. The fourth rung 34 is disposed above the upper third rung 33*b*. The round fifth rung 35 is disposed above the fourth rung 34. The round fifth rung 35 is disposed at the top 27.

Referring to FIG. 4 and again to FIG. 1, an identical bend 21 is disposed in each upper section 22 rail. The bend 21 is disposed between the fourth rung 34 and the rounded fifth rung 35.

Figure 6:
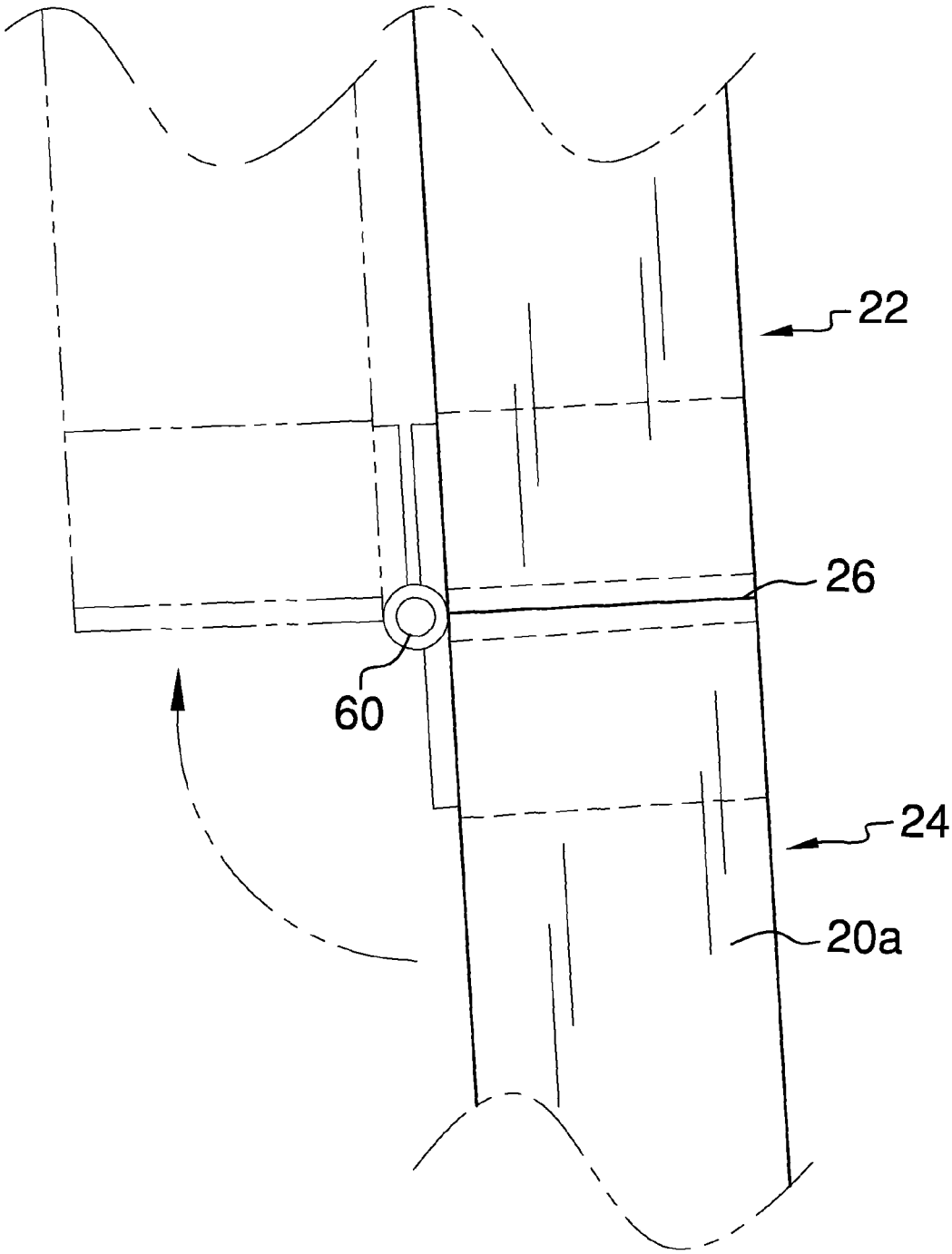
FIG. 6 is a lateral elevation view of the division, hinge and rails.

Referring to FIG. 6, the hinge 60 connects the upper third rung 33*b* to the lower third rung 33*a*. The hinge 60 extends from the first rail 20*a* to the second rail 20*b*. The hinge 60 provides 180 degrees of movement between the upper section 22 and the lower section 24.

Figure 3:
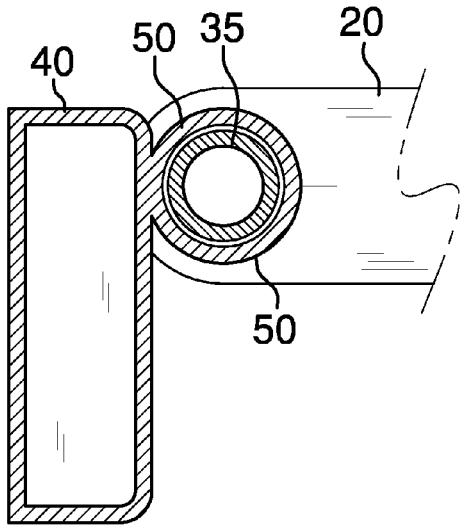
FIG. 3 is a partial cross sectional view of FIG. 2, taken along the line 3-3.
Figure 5:
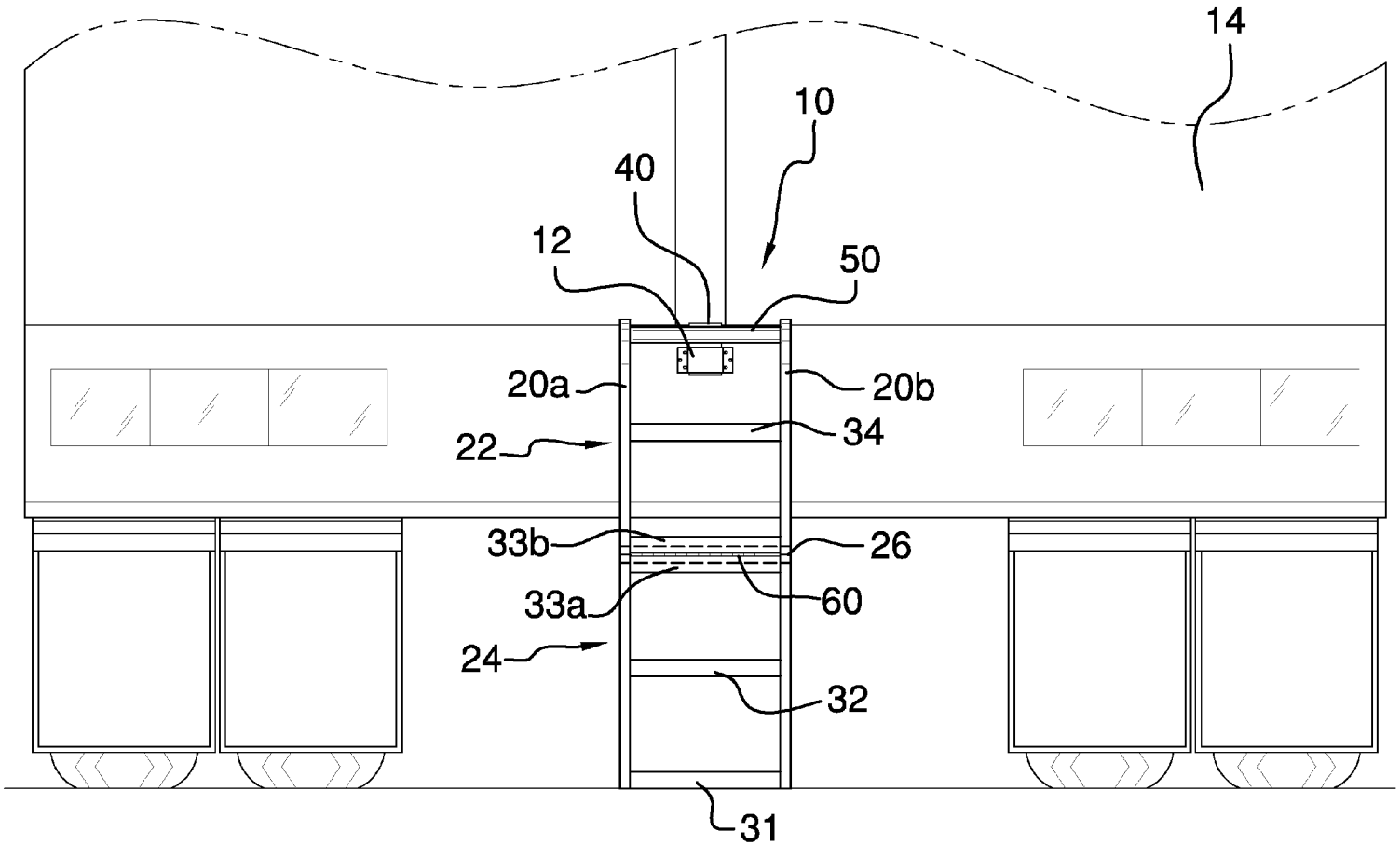
FIG. 5 is a rear elevation view of a trailer with the apparatus installed into a stake pocket.

Referring to FIGS. 3 and 5, the sleeve 50 is pivotally disposed around the round fifth rung 35. The sleeve 50 provides 360 degrees of rotation about the rounded fifth rung 35. The sleeve 50 extends from adjacent to the first rail 20*a* to adjacent to the second rail 20*b*.

Figure 2:
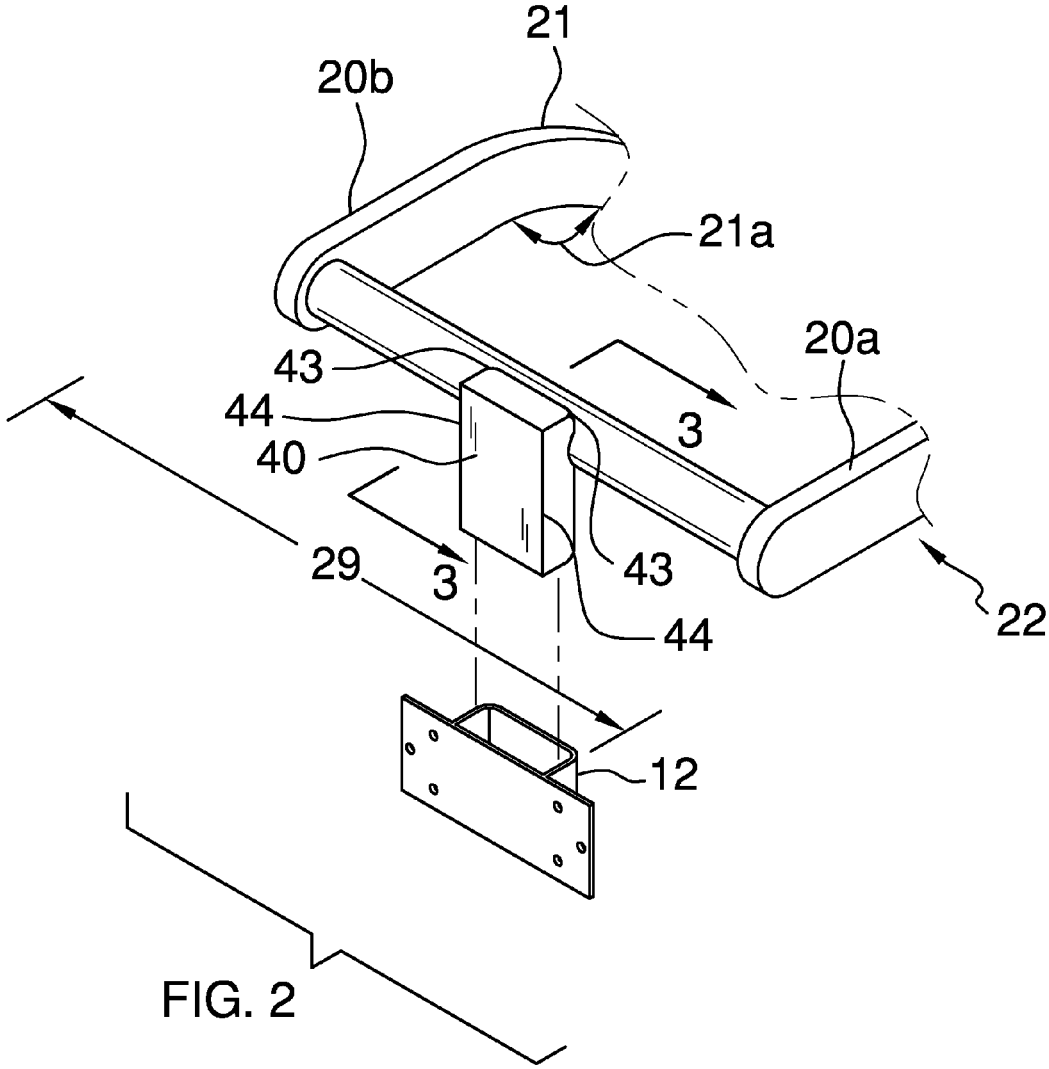
FIG. 2 is a perspective view of part of the upper section, prepared for insertion into the existing female stake pocket.

Referring to FIG. 2, the hexagonal stake 40 is attached centrally and perpendicularly on the sleeve 50. The stake 40 is disposed distally from the rails. The stake 40 comprises a pair of spaced apart square outer corners 43 disposed distally from the sleeve 50.

The pair of spaced apart rounded inner corners 44 is disposed against the sleeve 50. The width 29 of the apparatus 10 is about 18 inches.

Figure 4:
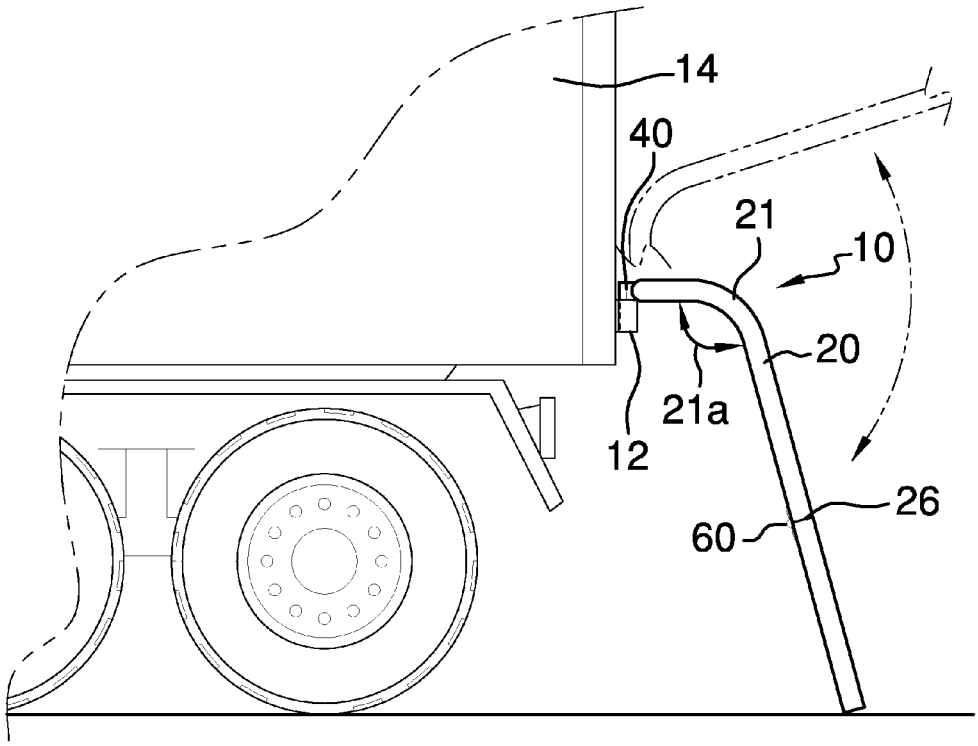
FIG. 4 is a lateral elevation view of the apparatus in use on a trailer.

Referring to FIGS. 2, 4, and 5, the stake 40 is removably disposed within an existing stake pocket 12 of a trailer 14 and a flatbed. The rounded inner corners 44 of the stake 40 importantly match the rounded corners of existing female pockets 12 disposed on and around most existing trailers 14.

Referring again to FIG. 1, the first rung 31, the second rung 32, the lower third rung 33*a*, the upper third rung 33*b*, the fourth rung 34 and the fifth rung 35 are tubular. Optionally, the first rung 31, the second rung 32, the lower third rung 33*a*, the upper third rung 33*b*, and the fourth rung 34 further comprise square tubing. The rails are optionally tubular. The tubular construction contributes to rigidity and importantly decreases weight of the apparatus 10.

Referring again to FIG. 3, the hexagonal stake 40 is ideally hollow. The apparatus 10 is provided in various lengths and further comprises a width 29 of about 18 inches.

With respect to the above description then, it is to be realized that the optimum dimensional relationships for the parts of the trailer and flatbed ladder apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the trailer and flatbed ladder apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the trailer and flatbed ladder apparatus may be used.

Therefore, the foregoing is considered as illustrative only of the principles of the trailer and flatbed ladder apparatus. Further, since numerous modifications and changes will readily occur to those skilled in the art, it is not desired to limit the trailer and flatbed ladder apparatus to the exact construction and operation shown and described, and accordingly, all suitable modifications and equivalents may be resorted to, falling within the scope of the trailer and flatbed ladder apparatus.

What is claimed is:

1. A trailer and flatbed ladder apparatus comprising a lower section;

an upper section hingedly attached to the lower section;

a division disposed between the lower section and the upper section, the upper section hingedly attached to the lower section at the division;

a pair of identical spaced apart rails extending along and as part of the upper section and lower section, the pair comprising a first rail and a second rail;

a plurality of spaced apart rungs disposed on the lower section between the rails, the rungs of the lower section comprising a first rung disposed on the bottom of the lower section, a second rung disposed above the first rung, a lower third rung disposed above the second rung, the lower third rung disposed at the division;

a plurality of spaced apart rungs disposed on the upper section between the first rail and the second rail the rungs of the upper section comprising an upper third rung disposed at the division, the upper third rung disposed adjacent to the lower third rung, a fourth rung disposed above the upper third rung, a fifth being round and rung having a circular cross-section, the fifth rung disposed above the fourth rung, the fifth rung disposed at the top;

an identical bend disposed in each rail in the upper section, the bend disposed between the fourth rung and the fifth rung;

a hinge connecting the upper third rung to the lower third rung at the division, the hinge providing 180 degrees of movement between the upper section and the lower section;

a sleeve pivotally disposed around the round fifth rung, the sleeve providing 360 degrees of rotation about the round fifth rung, the sleeve extended from adjacent to the first rail to adjacent to the second rail;

a stake attached perpendicularly and centrally to the sleeve, the stake disposed distally from the rails, the stake comprising a pair of spaced apart square outer corners disposed distally from the sleeve, a pair of spaced apart rounded inner corners disposed against the sleeve, the stake removably disposed within an existing stake pocket of a trailer and a flatbed.

2. The apparatus according to claim 1 wherein the hinge is further extended from the first rail to the second rail.

3. The apparatus according to claim 1 wherein the first rung, the second rung, the lower third rung, the upper third rung, the fourth rung and the fifth rung are tubular.

4. The apparatus according to claim 2 wherein the first rung, the second rung, the lower third rung, the upper third rung, the fourth rung and the fifth rung are tubular.

5. The apparatus according to claim 1 wherein the first rung, the second rung, the lower third rung, the upper third rung, and the fourth rung further comprise a square tubing.

6. The apparatus according to claim 5 wherein the rails are further tubular.

7. The apparatus according to claim 6 wherein the hexagonal stake is further hollow.

8. The trailer and flatbed ladder apparatus according to claim 7 further comprising a width of about 18 inches.

9. A trailer and flatbed ladder apparatus comprising:

a lower section;

an upper section hingedly attached to the lower section;

a division disposed between the lower section and the upper section, the upper section hingedly attached to the lower section at the division;

a pair of identical spaced apart rails extending along and as part of the upper section and lower section, the pair comprising a first rail and a second rail;

a plurality of spaced apart rungs disposed on the lower section between the rails, the rungs of the lower section comprising a first rung disposed on the bottom of the lower section, a second rung disposed above the first rung, a lower third rung disposed above the second rung, the lower third rung disposed at the division;

a plurality of spaced apart rungs disposed on the upper section between the first rail and the second rail, the rungs of the upper section comprising an upper third rung disposed at the division, the upper third rung disposed adjacent to the lower third rung, a fourth rung disposed above the upper third rung, a round fifth rung disposed above the fourth rung, the round fifth rung disposed at the top;

an identical bend disposed in each rail in the upper section, the bend disposed between the fourth rung and the round fifth rung;

a hinge connecting the upper third rung to the lower third rung, the hinge extended from the first rail to the second rail, the hinge providing 180 degrees of movement between the upper section and the lower section;

a sleeve pivotally disposed around the round fifth rung, the sleeve providing 360 degrees of rotation about the round fifth rung, the sleeve extended from adjacent to the first rail to adjacent to the second rail;

a stake attached perpendicularly and centrally on the sleeve, the stake disposed distally from the rails, the stake comprising a pair of spaced apart square outer corners disposed distally from the sleeve, a pair of spaced apart rounded inner corners disposed against the sleeve, the stake removably disposed within an existing stake pocket of a trailer and a flatbed.

10. The apparatus according to claim 9 wherein the first rung, the second rung, the lower third rung, the upper third rung, the fourth rung and the fifth rung are tubular.

11. The apparatus according to claim 10 wherein the first rung, the second rung, the lower third rung, the upper third rung, and the fourth rung further comprise a square tubing.

12. The apparatus according to claim 11 wherein the rails are further tubular.

13. The apparatus according to claim 12 wherein the stake is further hollow.

14. The trailer and flatbed ladder apparatus according to claim 13 further comprising a width of about 18 inches.

* * * * *